United States Patent [19]

Dinius

[11] 4,335,066

[45] Jun. 15, 1982

[54] METHOD OF FORMING A FIBROUS WEB WITH HIGH FIBER THROUGHPUT SCREENING

[75] Inventor: James H. Dinius, Neenah, Wis.

[73] Assignee: Kimberly-Clark Corporation, Neenah, Wis.

[21] Appl. No.: 266,753

[22] Filed: May 26, 1981

Related U.S. Application Data

[63] Continuation-in-part of Ser. No. 106,142, Dec. 21, 1979, abandoned.

[51] Int. Cl.[3] ..... B29C 13/00

[52] U.S. Cl. ..... 264/121

[58] Field of Search ..... 264/121

[56] References Cited

U.S. PATENT DOCUMENTS

| | | | |
|---|---|---|---|
| 2,447,161 | 8/1948 | Coghill | 92/38 |
| 2,714,749 | 8/1955 | Clark et al. | 425/83.1 |
| 2,720,005 | 10/1955 | Clark et al. | 425/83.1 |
| 2,738,556 | 3/1956 | Anderson | 425/83.1 |
| 2,738,557 | 3/1956 | Anderson | 425/80.1 |
| 2,748,429 | 6/1956 | Clark | 425/80.1 |
| 2,751,633 | 6/1956 | Clark | 425/80.1 |
| 2,810,940 | 10/1957 | Mills | 425/80.1 |
| 2,827,668 | 3/1958 | Clark | 425/83.1 |
| 2,931,076 | 4/1960 | Clark | 425/83.1 |
| 3,301,246 | 1/1967 | Wolfe | 124/13 |
| 3,575,749 | 4/1971 | Kroyer | 425/115 |
| 3,581,706 | 6/1971 | Rasmussen | 118/312 |
| 3,669,778 | 6/1972 | Rasmussen | 156/62.2 |
| 3,769,115 | 10/1973 | Rasmussen et al. | 156/62.2 |
| 3,976,412 | 8/1976 | Attwood et al. | 425/81 |
| 4,014,635 | 3/1977 | Kroyer | 425/82 |
| 4,060,360 | 11/1977 | Tapp | 425/83 |
| 4,074,393 | 2/1978 | Hicklin et al. | 19/303 |

FOREIGN PATENT DOCUMENTS 1088991 10/1967 United Kingdom .

*Primary Examiner*—James R. Hall

*Attorney, Agent, or Firm*—Stephen R. May; William D. Herrick

[57] ABSTRACT

Method for improving fiber throughput in a system for forming an air-laid web of dry fibers wherein individualized fibers and soft fiber flocs are separated from aggregated fiber masses by means of mechanical action in a system employing a plurality of fiber disintegrating rotors mounted for rotation in a horizontal plane about vertical axes and disposed over a generally planar sifting screen wherein the sifting screen comprises a plurality of closely spaced, elongated, narrow slots.

9 Claims, 6 Drawing Figures

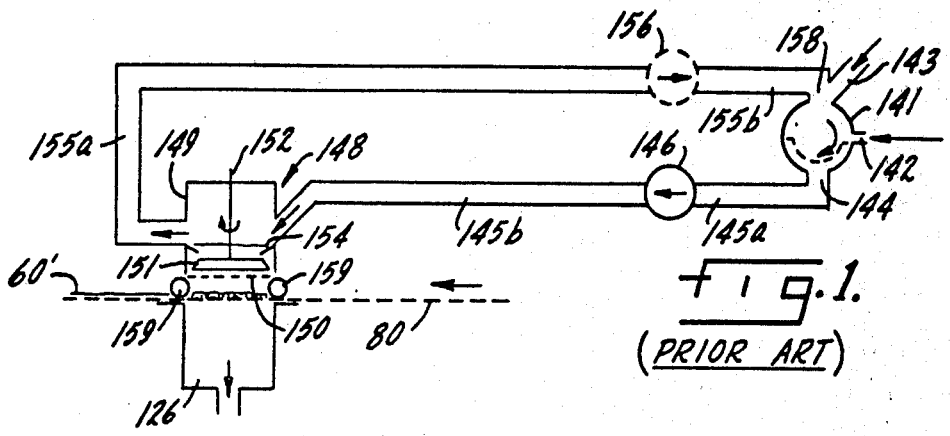
fig. 1.
(PRIOR ART)
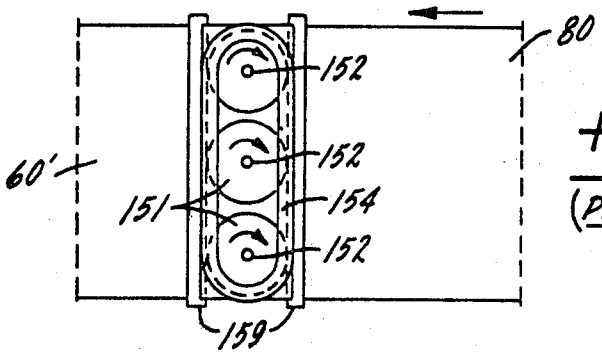
fig. 2.
(PRIOR ART)
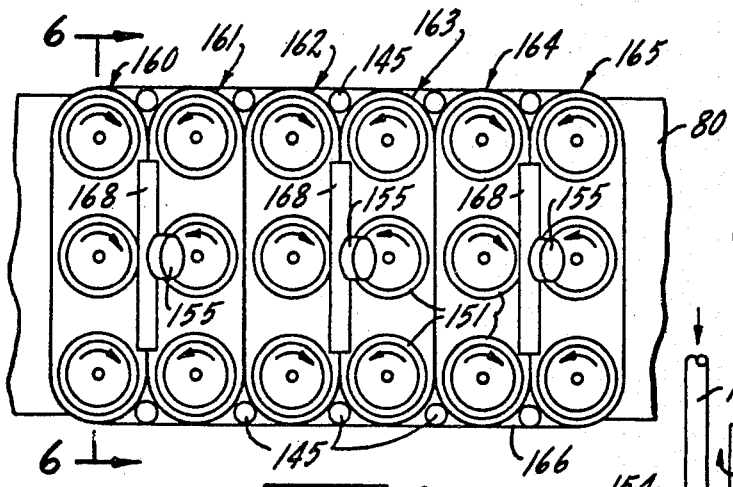
fig. 3.
(PRIOR ART)
fig. 4.
(PRIOR ART)
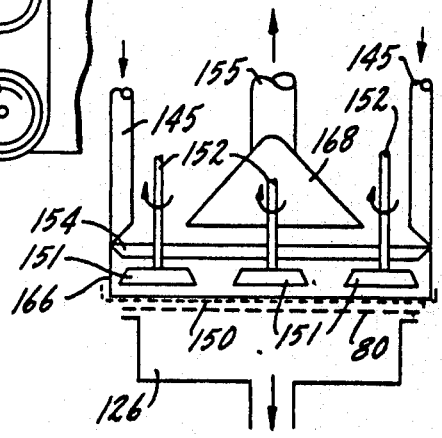

DRY FORMER FIBER DELIVERY RATES VS SCREEN OPENING

METHOD OF FORMING A FIBROUS WEB WITH HIGH FIBER THROUGHPUT SCREENING

This is a continuation of application Ser. No. 106,142, filed Dec. 21, 1979, now abandoned.

RELATED APPLICATIONS

David W. Appel and Raymond Chung Ser. No. 250,546, filed Apr. 3, 1981, for "Method and Apparatus For Forming an Air-Laid Web", which is a Continuation of Ser. No. 106,144, filed Dec. 21, 1979 now abandoned.

James H. Dinius and Raymond Chung Ser. No. 106,143, filed Dec. 21, 1979, for "High Fiber Throughput Screening System for Separating Aggregated Fiber Masses from Individualized Fibers and Soft Fiber Flocs and a System for Forming an Air-Laid Web of Dry Fibers".

Raymond Chung Ser. No. 250,545, filed Apr. 3, 1981, for "System For Forming An Air-Laid Web of Dry Fibers", which is a Continuation of Ser. No. 106,141, filed Dec. 21, 1979 now abandoned.

BACKGROUND OF THE INVENTION

The present invention relates in general to a method for forming non-woven fabrics, and, more particularly, to an improved method for improving the throughput capacity of a sifting type former employing a plurality of rotors mounted for rotation in a horizontal plane immediately above a sifting screen with each rotor being mounted for rotation about a vertical axis.

Conventionally, materials suitable for use as disposable tissue and towel products have been formed on papermaking equipment by water-laying a wood pulp fibrous sheet. Conceptionally, such equipment has been designed so that the configuration of the resulting sheet approaches a planar structure. This allows continuous operation at high speeds; and, such sheets may be formed at speeds of 3,000 to 4,000 feet per minute. Indeed, recent developments have allowed sustained production at speeds of up to 5,000 feet per minute.

Following formation of the sheet, the water is removed either by drying or by a combination of pressing and drying. As water is removed during formation, surface tension forces of very great magnitude develop which press the fibers into contact with one another, resulting in overall hydrogen bonding at substantially all fiber intersections; and a thin, essentially planar sheet is formed. It is the hydrogen bonds between fibers which provide sheet strength and, such bonds are produced even in the absence of extensive additional pressing. Due to this overall bonding phenomenon, cellulosic sheets prepared by water-laid methods inherently possess very unfavorable tactile properties (e.g., harshness, stiffness, low bulk, and poor overall softness) and, additionally, possess poor absorbency characteristics rendering such sheets generally unsuitable for use as sanitary wipes, bath and facial tissues, and toweling.

To improve these unfavorable properties, Sanford et al. U.S. Pat. No. 3,301,246 proposes improving the tactile properties of water-laid sheets by thermally predrying a sheet to a fiber consistency substantially in excess of that normally applied to the dryer surface of a paper machine and then imprinting the partially dried sheet with a knuckle pattern of an imprinting fabric. The sheet is thereafter dried without disturbing the imprinted knuckle-pattern bonds. While this method may somewhat improve the softness, bulk and absorbency of the resulting sheet, the spaces between the knuckle bonds are still appreciably compacted by the surface-tension forces developed during water removal, and considerable fiber bonding occurs. Creping is still essential in order to realize the maximum advantage of the proposed process; and, for many uses, two plies are still necessary.

As will be apparent from the foregoing discussion, conventional paper-making methods utilizing water are geared towards the high speed formation of essentially planar sheets; yet, such methods inherently possess the inefficient attribute of initial "overbonding", which then necessitates a creping step to partially "debond" the sheet to enhance the tactile properties. Also, the extreme water requirements limit the locations where paper-making operations may be carried out. Such operations require removing a large quantity of the water used as the carrier, and the used process water can create an associated water pollution problem. Still further, the essential drying procedures consume tremendous amounts of energy.

Air forming of wood pulp fibrous webs has been carried out for many years; however, the resulting webs have been used for applications where either little strength is required, such as for absorbent products—i.e., pads—or applications where a certain minimum strength is required but the tactile and absorbency properties are unimportant—i.e., various specialty papers. U.S. Pat. No. 2,447,161 to Coghill, U.S. Pat. No. 2,810,940 to Mills, and British Pat. No. 1,088,991 illustrate various air-forming techniques for such applications.

In the late 1940's and early 1950's, work by James D'A. Clark resulted in the issuance of a series of patents directed to systems employing rotor blades mounted within a cylindrical fiber "disintegrating and dispersing chamber" wherein air-suspended fibers were fed to the chamber and discharged from the chamber through a screen onto a forming wire—viz., J. D'A. Clark U.S. Pat. Nos. 2,748,429, 2,751,633 and 2,931,076. However, Clark and his associates encountered serious problems with these types of forming systems as a result of disintegration of the fibers by mechanical coaction of the rotor blades with the chamber wall and/or the screen mounted therein which caused fibers to be "rolled and formed into balls or rice which resist separation"—a phenomenon more commonly referred to today as "pilling". These problems, inter alia, and proposed solutions thereto, are described in, for example: J. D'A. Clark U.S. Pat. No. 2,827,668, J. D'A. Clark et al. U.S. Pat. Nos. 2,714,749, and 2,720,005; Anderson U.S. Pat. No. 2,738,556; and, Anderson et al. U.S. Pat. No. 2,738,557. However, prior to the advent of the present invention, it is not believed that systems of the type disclosed by J. D'A. Clark and his associates which employed cylindrical fiber disintegrating and dispersing mechanisms with and/or without rotors, have been suitable for use in production type, air-laid, dry fiber, web forming systems, principally because problems of pilling have not been resolved, and because of severe fiber damage due to the disintegrating action of the rotor in Clark's cylindrical chamber.

It should be noted that the aforesaid Clark et al. U.S. Pat. No. 2,720,005 discloses an air scrabbler system having a foraminous separating wall wherein slots may be formed in the wall rather than relatively small openings such as are employed with conventional woven square-mesh screens. The Clark et al. patent is silent as to the orientation of the slots. However, in the aforesaid Clark U.S. Pat. No. 2,748,429 which also contemplates the use of a slotted separating wall, the slots are shown and described as "circumferentially extending laterally spaced slots" (See, Col. 3, lines 22–23). Such slot orientation has been found to be substantially inoperable when utilizing 2-dimensional formers of the type employing a horizontally disposed rotor assembly.

A second type of system for forming air-laid webs of dry cellulosic fibers which has found limited commercial use has been developed by Karl Kristian Kobs Kroyer and his associates as a result of work performed in Denmark. Certain of these systems are described in: Kroyer U.S. Pat. Nos. 3,575,749 and 4,014,635; Rasmussen U.S. Pat. Nos. 3,581,706 and 3,669,778; Rasmussen et al. U.S. Pat. No. 3,769,115; Attwood et al. U.S. Pat. No. 3,976,412; Tapp U.S. Pat. No. 4,060,360; and, Hicklin et al. U.S. Pat. No. 4,074,393. In general, these systems employ a fiber sifting chamber or head having a planar sifting screen which is mounted over a forming wire. Fibers are fed into the sifting chamber where they are mechanically agitated by means of a plurality of mechanically driven rotors mounted for rotation about vertical axes. Each rotor has an array of symmetrical blades which rotate in close proximity to the surface of the sifting screen. The systems described in the aforesaid Kroyer and related patents generally employ two, three, or more side-by-side rotors mounted in a suitable forming head.

In an effort to overcome the productivity problems associated with such systems, complex production systems have been devised utilizing multiple forming heads—for example, up to eight separate spaced forming heads associated with multiple hammermills and each employing two or three side-by-side rotors. The most recent sifting type systems employing on the order of eighteen, twenty or more rotors per forming head, still require up to three separate forming heads in order to operate at satisfactory production speeds—that is, the systems employ up to fifty-four to sixty, or more, separate rotors with all of the attendant complex drive systems, feed arrangements, recycling equipment and hammermill equipment.

SUMMARY OF THE INVENTION

It is a general aim of the present invention to provide improved methods which significantly increase the productivity of conventional sifting systems used in the formation of air-laid webs of dry fibers and of the type employing multiple rotors mounted for rotation in a horizontal plane over a planar sifting screen, with each rotor mounted for rotation about a vertical axis.

In another of its important aspects, it is an object of the invention to provide a screen member for air-laid fiber formers of the type employing a planar sifting screen which permits of considerably higher fiber throughput than has heretofore been possible with conventional woven square-mesh screens through the use of slotted screen openings having long slot dimensions and short slot dimensions.

DESCRIPTION OF THE DRAWINGS

These and other objects and advantages of the present invention will become more readily apparent upon reading the following detailed description and upon reference to the attached drawings, in which:

FIGS. 1 and 2 are, respectively, schematic side elevational and plan views of a conventional prior art fiber sifting system utilized in the commercial manufacture of dry formed webs, generally of the type having basis weights on the order of 24 lbs./2880 ft.$^2$ or higher;

FIGS. 3 and 4 are, respectively, plan and side elevational views, schematically setting forth a modified form of commercially available dry forming sifter, with FIG. 4 having been taken substantially along the line 4—4 in FIG. 3;

Figure 5:
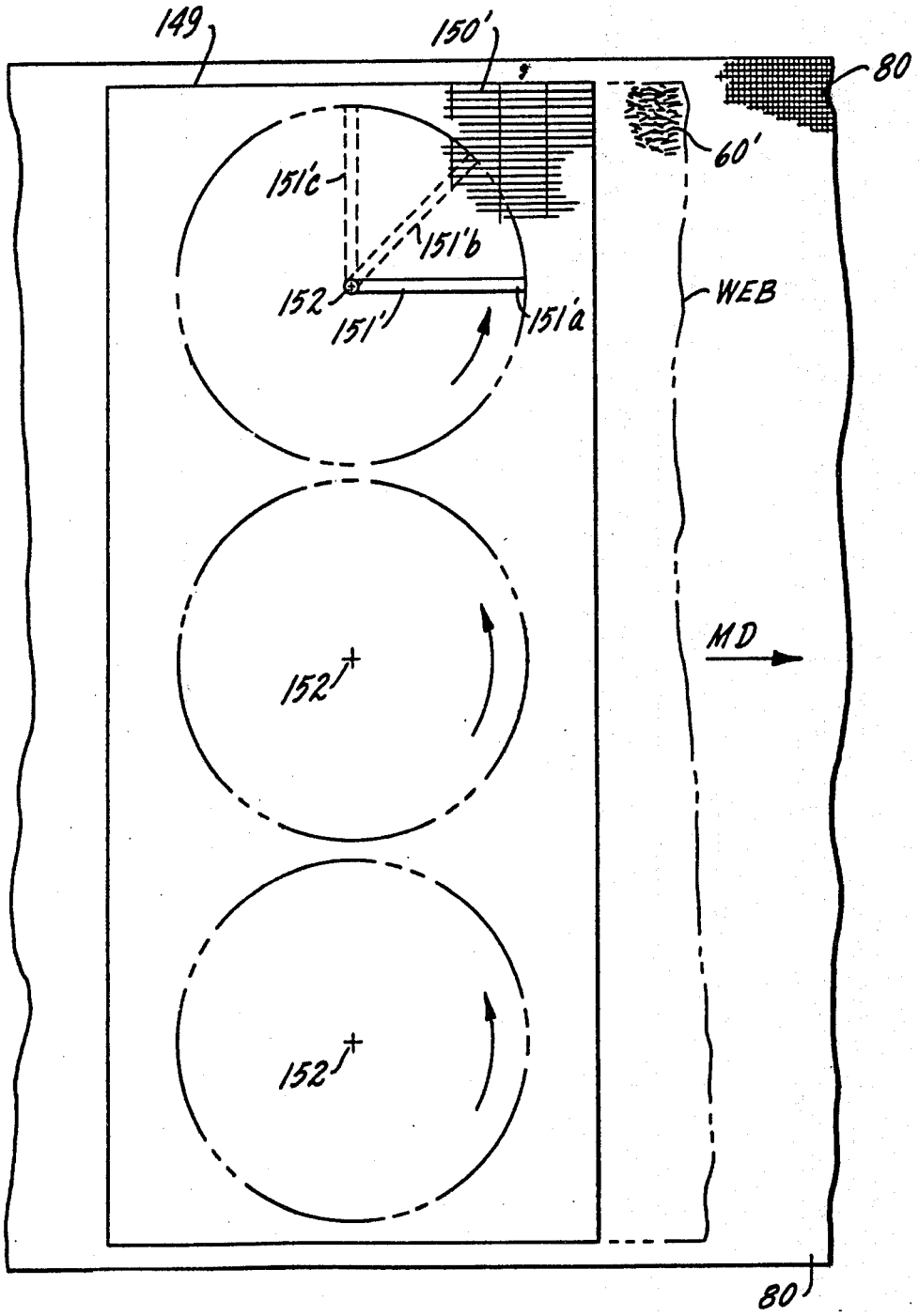
FIG. 5 is a diagrammatic plan view indicating fiber movement in a sifting type forming system of the types shown in FIG. 3, but here employing a high capacity slotted screen in accordance with the present invention; and, FIG. 6 is a graphic representation depicting the relationship between fiber delivery rates expressed as fiber throughput in pounds per square inch per hour (lbs./in.$^2$/hr.) and both woven square-mesh screens and slotted screens having screen openings ranging from about 0.03" in at least one direction to about 0.08" in at least one direction when using prior art systems of the types shown in FIGS. 1 and 3.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

DETAILED DESCRIPTION

The phrase "aggregated fiber masses" is herein used to generically embrace pulp lumps, pills, rice and/or nits, and to describe aggregations of bonded and/or mechanically entangled fibers generally having a bulk density on the order of greater than 0.2 grams per cubic centimeter (g./cc.). Aggregated fiber masses are to be distinguished from flocs and/or soft flocs whose bulk density is generally less than 0.2 g./cc. Moreover, aggregated fiber masses have a relatively low coefficient of drag in air.

"Bulk density" is the weight in grams of an uncompressed sample divided by its volume in cubic centimeters.

The phrase "2-dimensional" is used to describe a system for forming a web wherein: (i) the cross-section of the system and the flows of air and fiber therein are the same at all sections across the width of the system; and (ii), where each increment of system width behaves essentially the same as every other increment of system width; thereby permitting the system to be scaled up or down to produce high quality webs of any suitable and commercially useful widths on a high-speed production basis and wherein a web's cross-directional profile in terms of basis weight can be controlled and, preferably, can be maintained uniform.

The phrase "coefficient of variation" is used herein to describe variations in the cross-directional basis weight profile of both the web being formed and the fibrous materials input to the system, and comprises the standard deviation ($\sigma$) expressed as a percent of the mean.

Referring to FIGS. 1 and 2, there has been illustrated a conventional sifting system of the type described in the aforesaid Kroyer U.S. Pat. No. 4,014,635 for forming air-laid webs of dry fibers. As here shown, a hammermill 141 having a first inlet 142 for fibrous materials to be disintegrated and a second inlet 143 for permitting air intake, is provided with an outlet 144 coupled to a supply conduit 145*a*. A fan 146 serves to propel individualized fibers through conduits 145*a* and 145*b* to a forming head which here takes the form of a fiber distributor, generally indicated at 148.

The fiber distributor 148 is provided with a housing 149, a perforated planar bottom wall 150 in the form of a screen member, which conventionally comprises a woven square-mesh screen, and three sets of impellers 151. The impellers are mounted for rotation about vertical axes 152 in a horizontal plane located just above the perforated bottom wall or screen 150. An inwardly and downwardly inclined peripheral flange 154 is mounted on the housing 149 just above the plane of the impellers 151. An outlet recycle conduit 155*a* is coupled to the fiber distributor housing 149 just above inclined flange 154, the conduit 155*a* being coupled to recirculating conduit 155*b* by a fan 156, with conduit 155*b* connected to a recycle inlet port 158 associated with hammermill 141. Fibers passing through the perforated bottom wall or screen 150 are deposited on a foraminous forming wire 80, there being a suction box 126 positioned below the forming wire. The suction box 126 serves to generate a stream of air which, together with gravity, serves to provide positive deposition of the fibers on the wire 80. Rollers 159 are mounted at the upstream and downstream bottom edges of housing 149 and extend transversely across the forming wire 80—such rollers functioning as sealing members so as to preclude the intake of ambient air. Systems of the foregoing type are commercially available in several sizes—e.g., systems employing impellers 151 0.5 meters in width or 1 meter in width.

In operation, pulp or other fibrous material is subjected to intensive mechanical disintegration in hammermill 141, and the resulting individualized fibers, pills and pulp lumps are then fed into fiber distributor 148 where they are subjected to severe mechanical agitation by impellers 151. Such mechanical agitation results in stratification of the fibrous materials, with the fiber materials said to move downwardly below the inclined flange 154, and the coarser materials rising upwardly above the flange 154 where such coarse materials are recycled to hammermill 141 for secondary hammermilling operations. The finer materials include individual fibers, soft fiber flocs (accumulations of fibers which behave like individual fibers in an air stream) and relatively small nits which are mechanically propelled across the surface of and through the perforate bottom wall or screen 150 by the agitating and sifting action provided by the impellers 151. That material passing through the perforate bottom wall or screen 150 is then deposited on the forming wire 80 by means of gravity and the air stream generated by suction box 126 to form an air-laid web 60' of dry fibers.

The foregoing sifting system shown by way of example in FIGS. 1 and 2 has proven suitable for forming relatively high basis weight webs (24 lbs./2880 ft.$^2$ or greater) where the nature of the end use contemplated permits of webs having mechanically shortened and curled fibers (resulting from grinding of fibers between impellers 151 and bottom wall or screen 150) and randomly located small nits, both of which tend to decrease the tensile strength of the web. Moreover, it has been found that extremely high fiber recycle percentages must be maintained when attempting to form webs, particularly when attempting to form relatively light basis weight webs suitable for bath and/or facial tissues. As a result, productivity of the fiber distributor 148 is extremely low, and a large percentage of the input fibers are subjected to secondary hammermilling operations which tend to further shorten, curl and otherwise damage the fibers and which require excessive amounts of energy consumption. And, of course, the rotary sifting action of the impellers 151 tends to roll fibers between the impeller blades and the housing 149, as well as between the impeller blades and both the screen 150 and the inclined flange 154, thus generating a large number of undesired pills which increases the recycle percentage.

Faced with continuing unresolved productivity problems, especially in the manufacture of lightweight tissues, a new type of fiber distributing head has been proposed. One such exemplary system is illustrated diagrammatically in FIGS. 3 and 4. As illustrated, this adaptation of the sifting system is said to include six adjacent rows of contra-rotating impellers 151, such rows being generally indicated at 160–165 in FIG. 3, with each row including multiple impellers—e.g., three impellers per row—or, a total of eighteen impellers contained within a single housing 166 mounted over a forming wire 80. As in the equipment shown in FIGS. 1–2, the impellers 151 are mounted for rotation about vertical axes 152 in a horizontal plane located just above a perforate bottom wall or conventional square-mesh screen 150 as is best illustrated in FIG. 4.

As with the equipment shown in FIGS. 1 and 2, the multiple row arrangement is also provided with a series of inwardly extending, downwardly inclined peripheral flanges 154 suitable for classifying the fine and coarse material in a stratification process. Thus, individualized fibers are fed to the unit through a multiplicity of supply conduits 145, while coarse materials to be recycled for secondary hammermilling operations are withdrawn through a recycle conduit 155 having a flat, funnel-shaped inlet 168 located just above the inclined flanges 154. As here shown, three such recycle systems are provided—viz., one between the rows 160, 161, a second between rows 162, 163, and a third between the rows 164, 165. Thus, the arrangement is such that fibers introduced into the unit are stratified by action of the contra-rotating impellers—i.e., the impellers in rows 160, 162 and 164 here being illustrated as rotating in a clockwise direction, while the impellers in rows 161, 163 and 165 are rotating in a counterclockwise direction—with the fine materials being sifted through the screen after mechanical agitation by impellers 151 which tend to carry individualized fibers across the perforate bottom wall or screen 150 in a serpentine or "racetrack" pattern and ultimately passing through the screen from which they are deposited on forming wire 80 as a result of gravity and the air stream generated by suction box 126 beneath housing 166.

Published literature describing such sifting systems has indicated that as many as three separate units are mounted over a single forming wire. It will be apparent that such an arrangement would employ up to fifty-four, or more, contra-rotating impellers requiring complex, expensive and cumbersome drive systems together with attendant fiber supply, fiber recycling, and hammermill equipment. It would seem apparent, however, that even if the output capacity of the combined units is such as to permit high-speed operation of the forming wire 80, undesired wave patterns caused by uneven fiber flow through the bottom wall or screen 150 will continue to exist. And, of course, it would also seem apparent that the severe mechanical agitation of fibers will result in shortening and curling of individualized fibers, high percentages of pill formation, and high recycle percentages, thereby inherently producing all of the disadvantages discussed above.

As is disclosed in the above mentioned copending application Ser. No. 106,144, an air-forming process utilizing an apparatus known as a "2-dimensional" rotary former, wherein rotor bars rotate about a horizontal axis within a cylindrical forming head, use of a slotted screen, with the long dimensions of the slots oriented parallel to the axis of the rotor assembly, resulted in significantly increased throughput when compared with a square mesh screen member. Conversely, when the long dimension of the slots was oriented in the direction of the rotor bar movement, the screen plugged up almost instantaneously. If such teaching is applied to the method of the present invention, the long dimensions of a slotted screen would have to be located radially, extending outwardly from the axis of each rotor so that the slots are oriented parallel to the rotor blade at all times. Such a screen would be difficult, if not impossible, to construct.

In accordance with one of the important aspects of the present invention, provision is made for substantially improving the fiber throughput capacity of conventional sifting type formers of the types shown in FIGS. 1–2 which employ planar screens, yet without the need to provide a specially designed slotted screen as noted above. More specifically, provision is made for replacing the conventional woven square-mesh screen 150 shown in FIG. 1 with a high capacity slotted screen employing screen openings in the form of closely spaced parallel slots.

To this end, and as best illustrated in FIG. 5, a high capacity slotted screen 150' is mounted with housing 149 of the fiber distributor 148 and located immediately below a plurality of impellers 151 mounted for rotation in a horizontal plane about vertical axes 152. As here shown, the apparatus is generally identical to that illustrated in FIGS. 1 and 2, except for the use of a slotted screen 150' instead of a woven square-mesh screen 150 (FIG. 1). Thus the fiber distributor is shown as including three side-by-side impellers 151, with the fiber distributor 148 disposed above a moveable foraminous forming surface 80 and adapted to form an air-laid web 60' thereon as fibers are sifted through the slotted screen 150' by virtue of the rotary action of the impeller 151.

Referring more particularly to the uppermost impeller 151' as viewed in FIG. 5 and, more specifically to a single impeller blade 151' which is here diagrammatically shown as rotating in a counterclockwise direction as viewed in the drawing, it will be observed that when the perforated bottom wall 150 in the form of slotted screen 150' is mounted with the long slot dimensions oriented in the machine direction—i.e., the direction of movement of the forming surface 80 as indicated by the arrow MD—each impeller blade 151' will sweep over the screen 150' as it moves about its axis of rotation 152. Consequently, when the impeller blade 151' is in the position indicated at 151'*a*, the impeller blade is oriented parallel to the underlying long slot dimension and, therefore, the operating condition is analogous to that of the maximum throughput condition of a rotary former as disclosed in Ser. No. 106,144. When the impeller blade 151' has moved 45° to the position shown at 151'*b*, the impeller blade 151' sweeps across the screen openings at an acute angle and the slotted screen in a 2-dimensional former of Ser. No. 106,144 plugged almost completely and instantaneously. And, when the impeller blade 151' moves through an additional angle of 45° to the position as indicated at 151'*c* in FIG. 5, the operating condition is analogous to the situation with a 2-dimensional rotary former when it plugged up instantaneously.

However, in a system of the type shown in FIG. 5, no appreciable plugging of the slotted screen 150' was detected at any portion of the screen irrespective of the angular relation between the impeller blades 151' and the long dimensions of the slotted screen openings. As will be described in greater detail below, not only was no significant screen plugging action observed but, moreover, significant improvement was detected in terms of fiber throughput through the screen and, therefore, in the productive capacity of the fiber distributor 148.

Those skilled in the art will appreciate that, as thus far described, similar results would be achieved if the slotted screen 150' were mounted with the long slot dimensions extending in the cross-machine direction—i.e., at right angles to the orientation shown in FIG. 5. Thus, in this case (not shown), an impeller blade 151' would, when in the position indicated at 151'*a*, be perpendicular to the long slot dimension, when in the position indicated at 151'*c*, be parallel to the long slot dimension. Again, the experimental results reported below indicate that no significant screen plugging occured, and fiber throughput is significantly improved as contrasted with such systems when woven square-mesh screens are employed.

EXAMPLES

The ensuing portion of the present specification includes a discussion of the effects of varying various system parameters when utilizing conventional prior art equipment of the type generally illustrated in FIGS. 1–2 with conventional woven square-mesh screens on the one hand, and with slotted screens oriented in both the machine direction and the cross-machine direction on the other hand. The Examples given are of actual experimental runs made with the equipment and have been randomly selected solely for the purpose of illustrating the effect of varying one or more of the operating parameters. No effort has been made to optimize operating conditions for each different given Example; although, certain of the Examples do reflect sets of operating parameters which either approach optimized conditions, are at or about optimized conditions, or somewhat exceed optimized conditions. Data for the various parameters for each of the Examples given are set forth in tabular form in Tables I and II inclusive. Examples I–IV represent operating parameters for commercially available prior art equipment using woven square-mesh screens; whereas Examples V–X represent operating parameters for such a prior art web forming system when using slotted screens in accordance with the present invention.

It should further be noted that fiber throughput is, in part, a function of the type and quality of the fibers being utilized. Moreover, when forming webs suitable for toweling and similar relatively high basis weight webs, nits are not as objectionable as when forming lightweight tissue products. Consequently, when prior art sifting systems of the types shown in FIGS. 1–2 are used to form relatively heavy basis weight webs suitable for towels and the like, it has been common to use fibrous materials which differ in grade and quality from those normally used by the assignee of the present invention. This fact, together with the willingness of some persons to accept high nit levels in towel-like products, has resulted in some reports of throughput and/or recycle percentages for such prior art systems which are somewhat better than those reported herein. However in the experimentation herein reported, fibers of like grade and quality were used with both the prior art systems when using both conventional woven square-mesh screens and slotted screens. In all Examples, the fibers used were cellulosic wood fibers—viz., Northern Softwood Kraft (NSWK).

Examples I through IV (Table I, infra) contain data pertaining to air-laid web forming runs conducted on conventional prior art equipment of the type shown in FIGS. 1–2 and, in each instance, the fiber distributor 148 includes a conventional woven square-mesh screen 150. In the case of Examples I and II, the system employed four fiber distributors whereas Examples III and IV represent similar data collected in connection with the formation of webs employing a system having only a single fiber distributor 148 such as that shown in FIGS. 1 and 2, but including only two impellers 151 (a modification which affects only the width of the web). Consequently, since the webs of Examples I and II were formed using four tandem fiber distributors 148A–148D, the forming wire speeds achieved are considerably higher than the comparable forming wire speeds that could be achieved in subsequent Examples. Indeed, assuming all other operating parameters to be equal, the forming wire speeds for Examples I and II would be expected to be four times the speeds reflected in subsequent examples where the basis weight of the web being formed remains unchanged.

Considering first Examples I and II, it will be noted that rotor speeds were only 780 RPM and 790 RPM, respectively, and that 33% and 34% respectively, of the fibrous materials input to the system were recycled. As a consequence, fiber throughput—viz., the quantity of fibrous material passing through the screen 150, amounted to 0.12 lbs./hr./in.$^2$ and 0.095 lbs./hr./in.$^2$, respectively.

TABLE I

| Example No. | I | II | III | IV | V |
|---|---|---|---|---|---|
| Former[1] | A | A | B | B | C |
| Run No. | 1109 | 1039 | 2615 | 2584 | 2586 |
| Fiber Feed Rate-lbs./in./hr.[2] | 29.2 | 22.6 | 2.6 | 6.11 | 6.25 |
| Top Air Supply-ft.$^3$/min./in. | 420 | 420 | 88 | 88 | 88 |
| Air-to-Fiber Ratio-ft.$^3$/lb. | 823 | 1115 | 2030 | 864 | 845 |
| No. of Rotors | 12 | 12 | 2 | 2 | 2 |
| Rotor Speed-RPM | 780 | 790 | 1100 | 1100 | 1100 |
| Screen Type | 10 × 10<br>12 × 12 | 10 × 10<br>12 × 12 | 12 × 12 | 12 × 12 | 10 × 2.67 |
| Screen Opening-Inches | .075<br>.060 | .075<br>.060 | .060 | .060 | .052 |
| % Open Screen Area | 56.3<br>51.8 | 56.3<br>51.8 | 51.8 | 51.8 | 41.0 |
| % Fiber Recycled | 33 | 34 | 50 | 64 | 30 |
| Amount Fiber Recycled-lbs./in./hr. | 9.7 | 7.7 | 1.3 | 3.9 | 1.9 |
| Fiber Throughput-lbs./hr./in.$^2$ | .12 | .095 | .066 | .11 | .22 |
| Forming Wire Speed-ft./min. | 600 | 500 | 24 | 70 | 130 |
| Product Made | Facial Tissue | Facial Tissue | Towel | Facial Tissue | Facial Tissue |
| Basis Weight-lbs./2880 ft.$^2$ | 18.7 | 17.0 | 30.8 | 18.1 | 19.4 |
| Coefficient of Variation-C.D. % | 2.8 | 4.7 | 7.1 | 2.88 | 2.3 |
| Tensile-Gms./3" C.D. Width | 325 | 411 | 153 | 421 | 530 |

[1]Former "A" is a prior art former of the type shown in FIGS. 1 and 2, employing four distributor heads 148 in tandem, alternate ones of such heads respectively having 10 × 10 and 12 × 12 square-mesh screens, and each head being one meter in width.
Former "B" is a prior art former of the type shown in FIGS. 1 and 2, employing one distributor head 148 with two side-by-side rotors each one-half meter in diameter, and a woven square-mesh screen.
Former "C" is a prior art former of the type shown in FIGS. 1 and 2, employing one distributor head 148 with two side-by-side rotors each one-half meter in diameter, but here employing a high capacity slotted screen in accordance with the invention with the long dimensions of the slots oriented in the machine direction.
[2]Fiber feed rates as stated represent maximum former capacity for the operating parameters established.

The webs produced had basis weights of 18.7 and 17.0 lbs./2880 ft.$^2$ and coefficients of variation of 2.8% and 417%, respectively; and, consequently, were suitable for use as quality facial tissues assuming the nit levels (not reported here) to be satisfactory.

In Examples III and IV (Table I, supra) conventional woven square-mesh screens were again employed. In these two Examples (as well as in subsequent Examples V–X) the amount of top air supplied was held constant at 88 ft.$^3$/min./in. Impeller speed was increased significantly relative to Examples I and II and in both Examples III and IV, as well as in subsequent Examples V–X, was maintained constant at 1100 RPM. Under these operating conditions, the recycle percentages were 50% an 64% for Examples III and IV, respectively.

Under the operating parameter conditions established, fiber throughput capacity—the most relevant indicator of system productivity and the parameter of most interest in connection with the present invention—was 0.066 lbs./hr./in.$^2$ for Example III, and 0.11 lbs./hr./in.$^2$ for Example IV. Thus, on average, fiber throughput capacity for the four operating runs represented by Examples I–IV using prior art systems with conventional woven square-mesh screens was 0.098 lbs./hr./in.$^2$. Considering only Examples III and IV (where the forming system employed was, with the exception of the sifting screen, identical to that used for Examples V through X, and where the operating system parameters in terms of impeller speed and design, air supply, and recycle percentage were maintained relatively constant, the average fiber throughput capacity was only 0.088 lbs./hr./in.$^2$.

In Example III, the forming wire was run at a relatively low speed and, consequently, the product produced was an air-laid towel having a basis weight of 30.8 lbs./2880 ft.$^2$. The coefficient of variation was 7.1% and tensile strength was relatively low. In Example IV, a facial tissue having a basis weight of 19.4 lbs./2880 ft.$^2$ and a coefficient of variation of 2.88% was produced.

Turning now to Examples V (Table I, supra) and VI through X (Table II, infra), the identical prior art equipment used in forming the webs of Examples III and IV was modified in accordance with the present invention by removing the conventional woven square-mesh screen 150 (FIGS. 1–2) and replacing it with a slotted screen 150'. In Examples V through VIII, the long slot dimensions of the slotted screen 150' were oriented to extend in the machine direction; whereas in Examples IX and X the long slot dimensions were oriented in the cross machine direction. As previously indicated other system operating parameters were maintained relatively constant and comparable to those established for Examples III and IV.

Referring first to Example V (Table I, supra), it will be noted that fiber throughput capacity when using a slotted screen in accordance with the present invention was increased to 0.22 lbs./hr./in.$^2$ or, more than double the capacity achieved on average for Examples I through IV and almost double the maximum capacity achieved in Example I of 0.12 lbs./hr./in.$^2$.

TABLE II

| Example No. | VI | VII | VIII | IX | X |
|---|---|---|---|---|---|
| Former[1] | C | C | C | D | D |
| Run No. | 2656 | 2670 | 2661 | 2585 | 2655 |
| Fiber Feed Rate-lbs./in./hr.[2] | 9.97 | 7.72 | 8.74 | 11.74 | 7.88 |
| Top Air Supply-ft.$^3$/min./in. | 88 | 88 | 88 | 88 | 88 |
| Air-to-Fiber Ratio-ft.$^3$/lb. | 530 | 684 | 604 | 450 | 670 |
| No. of Rotors | 2 | 2 | 2 | 2 | 2 |
| Rotor Speed-RPM | 1100 | 1100 | 1100 | 1100 | 1100 |
| Screen Type | 10 × 2.67 | 10 × 2.67 | 14 × 3.5 | 10 × 2.67 | 10 × 2.67 |
| Screen Opening-Inches | .052 | .052 | .041 | .052 | .052 |
| % Open Screen Area | 41.0 | 41.0 | 45.4 | 41.0 | 41.0 |
| % Fiber Recycled | 53 | 40 | 70 | 46 | 46 |
| Amount Fiber Recycled-lbs./in./hr. | 5.3 | 3.1 | 6.1 | 5.4 | 3.6 |
| Fiber Throughput-lbs./hr./in.$^2$ | .237 | .235 | .13 | .32 | .215 |
| Forming Wire Speed-ft./min. | 155 | 140 | 90 | 200 | 140 |
| Product Made | Facial Tissue | Facial Tissue | Facial Tissue | Facial Tissue | Facial Tissue |
| Basis Weight-lbs./2880 ft.$^2$ | 17.4 | 19.1 | 16.5 | 18.1 | 17.5 |
| Coefficient of Variation-C.D. % | 5.58 | 8.8 | 6.6 | 5.8 | 5.02 |
| Tensile-Gms./3" C.D. Width | 483 | 687 | 533 | 446 | 522 |

[1]Former "C" is a prior art former of the type shown in FIGS. 1 and 2, employing one distributor head 148 with two side-by-side rotors each one-half meter in diameter, but here employing a high capacity slotted screen in accordance with the invention with the long dimensions of the slots oriented in the machine direction.
Former "D" is a prior art former of the type shown in FIGS. 1 and 2, employing one distributor head 148 with two side-by-side rotors each one-half meter in diameter, but here employing a high capacity slotted screen in accordance with the invention with the long dimensions of the slots oriented in the cross-machine direction.
[2]Fiber feed rates as stated represent maximum former capacity for the operating parameters established.

A facial tissue having a basis weight of 19.4 lbs./2880 ft.$^2$ and a coefficient of variation of 2.3% was produced.

Turning to Examples VI through VIII (Table II, infra), it will be observed that facial tissue grade webs were produced having basis weights of 17.4, 19.1 and 16.5 lbs./2880 ft.$^2$, respectively, and coefficients of variation of 5.58%, 8.8% and 6.6%, respectively. Fiber throughput capacity for Examples VI and VII were 0.237 and 0.235 lbs./hr./in.$^2$—i.e., slightly higher than the excellent result achieved in Example V.

In Example VIII, the slotted screen was replaced with a relatively fine slotted screen, as contrasted with the coarser slotted screen used in other Examples—i.e., the screen was a 14×3.5 screen having a 0.041" opening and 45.4% open area, as contrasted with 10×2.67 screen having a 0.052" opening and 41% open area. In this case, fiber throughput capacity dropped to 0.13 lbs./hr./in.$^2$ or, approximately 50% better than the average for Examples III and IV, but only about 30% better than the average for Examples I–IV and approximately the same as that achieved with Example I.

In Examples IX and X, the slotted screen was oriented with the long slot dimensions extending in the cross-machine direction. Fiber throughput capacities were 0.32 and 0.215 lbs./hr./in.$^2$, or better than three times and two times as great respectively as the capacities achieved on average for Examples I–IV. Facial grade tissue webs having basis weights of 18.1 and 17.5 lbs./2880 ft.$^2$ and coefficients of variation of 5.8% and 5.02%, respectively, were formed.

Thus, when comparing Examples V–VII, IX and X with Examples III and IV where the operating parameters were essentially the same except for the screen, fiber throughput capacity, on average, was almost 280% improved when using a slotted screen, and the improvement was obtained irrespective of the orientation of the screen slots.

Figure 6:
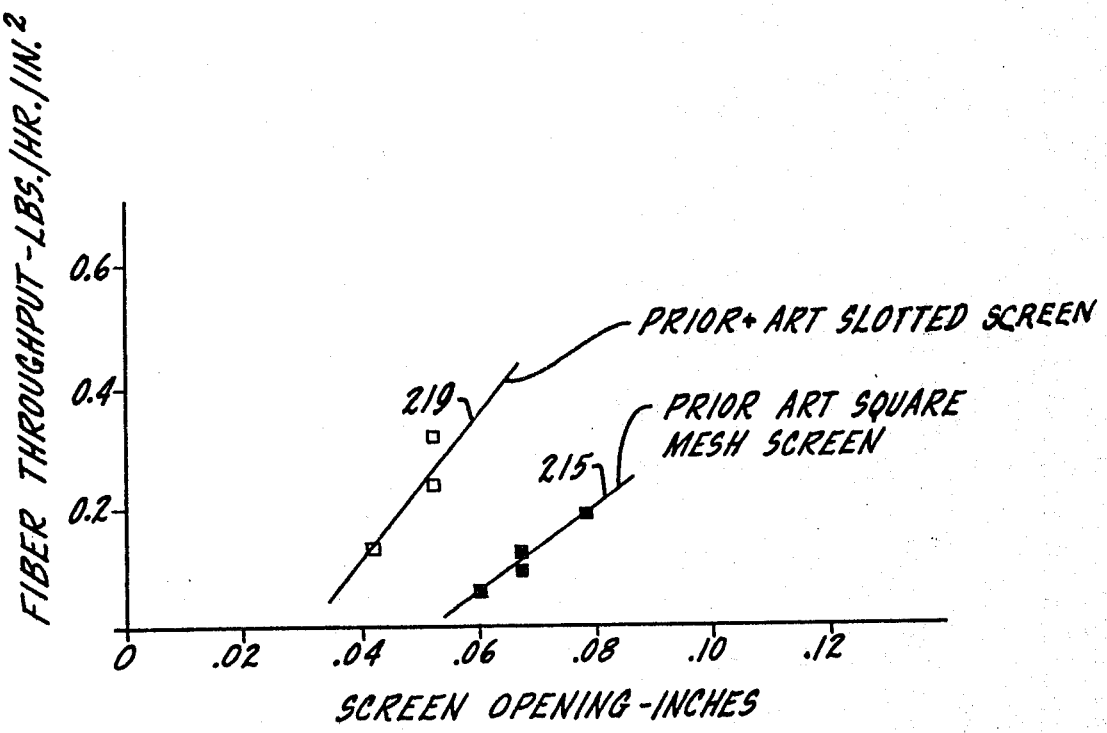

It is believed that the numerical data set forth in connection with Examples I through X clearly evidences the significant improvement obtained in fiber throughput—i.e., productivity rate—when practicing the present invention as contrasted with using known conventional forming systems of the types shown in FIGS. 1–2. However, the dramatic improvement in throughput is made even more evident upon inspection of that data as reproduced in graphic form in FIG. 6. Thus, as here shown fiber throughput for each of Examples I through X in lbs./hr./in.$^2$ (the ordinate in FIG. 6) has been plotted versus the screen opening size in inches used with each Example (the abscissa in FIG. 6). The line 215 is thus representative of fiber throughput when using conventional woven square-mesh screens in a conventional prior art system and has been generated from the throughput data given in Table I for Examples I through IV. The remarkably improved throughput achieved with the present invention when using slotted screens with such conventional prior art systems is graphically depicted in FIG. 6 by reference to the line 219 where the data for Examples V (Table I, supra) and VI through X (Table II, supra) has been used to generate the curve.

Based on the experimental data reported herein, it is evident that the present invention provides a dramatic improvement in fiber throughput capacity for the forming head. Thus, the data reflects fiber throughputs ranging from somewhat in excess of 0.13 lbs./hr./in.$^2$ (Example VIII) to in excess of 0.32 lbs./hr./in.$^2$ (Example IX) when working with cellulosic wood fibers and a former 148 with two side-by-side impellers each 0.5 meters in diameter. Moreover, it should be noted that the foregoing range of from 0.13 lbs./hr./in.$^2$ to at least 0.32 lbs./hr./in.$^2$ reflects efforts made to form high quality, lightweight tissue and/or towel grade products. Where product quality in terms of, for example, nit level can be accepted at lower quality levels, it can be expected that fiber throughput will exceed and, may substantially exceed, the level of 0.32 lbs./hr./in.$^2$. Similarly, when actual production experience is acquired, it can be expected that fiber throughputs will be regularly achieved which do exceed the level of 0.32 lbs./hr./in.$^2$, and such improved results may also be achieved when the system is scaled up in size—e.g., to impeller assemblies on the order of one meter in diameter. Therefore, the phrase "to at least 0.32 lbs./hr./in.$^2$" as used herein and in the appended claims is not intended to place an upper limit on throughput capacity.

Those skilled in the art will appreciate that there has herein been described an improved web forming system which is effective in forming air-laid webs of dry fibers at commercially acceptable production speeds irrespective of the basis weight of the web being formed even though the system is conventional in every respect except for the provision of slotted screens.

What is claimed is:

1. In a method of forming an air-laid web of dry fibers on a high speed production basis comprising:

(a) delivering dry fibrous materials to a fiber distributing head of the type employing a plurality of rotors mounted for rotation about vertical axes with their blades rotating in at least one horizontal plane above a screened discharge opening;

(b) agitating the fibrous materials within the fiber distributing head with said plurality of rotating rotors to stratify the fibers with relatively coarse fibers rising within the head and being discharged therefrom through a fiber recycle outlet and relatively fine fibers being discharged through said screened discharge opening;

(c) sifting the relatively fine fibers through a screen member; and, (d) collecting said fibers sifted through said screen member on a forming surface moving in a machine direction, wherein said fibers are collected on said forming surface in the form of a web of dry fibers, the improvement comprising:

said screen member being provided in the form of a slotted screen, with screen openings having a long slot dimension and a short slot dimension.

2. The method of claim 1, wherein in step (c) the fiber throughput capacity is 0.13–0.32 lbs./hr./square inch of screen surface.

3. The method of claim 2, wherein in step (c) the fiber throughput capacity is 0.22 lbs./hr./square inch screen surface.

4. The method of claim 1, wherein said slotted screen is oriented with the long slot dimensions extending in the machine direction.

5. The method as set forth in claim 4, wherein the fiber throughput capacity is 0.22 lbs./hr./square inch screen surface.

6. The method of claim 1, wherein said slotted screen is oriented with the long slot dimensions extending perpendicularly to the machine direction.

7. The method of claim 6, wherein the fiber throughput capacity is 0.22 lbs./hr./in.$^2$.

8. The method of claim 1, wherein said slotted screen has approximately 10×2.67 screen openings per square inch with screen openings on the order of 0.052" and approximately 41% open screen area, and wherein the fiber throughput capacity is approximately 0.245 lbs./hr./square inch screen surface.

9. The method of forming an air-laid web of dry fibers on a high speed production basis comprising:

(a) delivering dry fibrous materials to a fiber distributing head of the type employing a plurality of rotors mounted for rotation about vertical axes with their blades rotating in a horizontal plane above a screened discharge opening;

(b) agitating the fibrous materials within the fiber distributing head so as to stratify the fiberous materials with relatively coarse fibers rising within the head and being discharged therefrom and relatively fine fibers being discharged through said screened discharge opening;

(c) sifting the relatively fine fibrous material through a slotted screen; and, (d) air-laying the fibrous materials sifted through the slotted screen on a moving forming surface.

* * * * *